US006827651B1

(12) United States Patent
Davis

(10) Patent No.: US 6,827,651 B1
(45) Date of Patent: Dec. 7, 2004

(54) BILLIARD TRAINING AID

(76) Inventor: Mark Anthony Davis, 1224 Drivers Cir., Rocky Mount, NC (US) 27804

( * ) Notice: Subject to any disclaimer, the term of this patent is extended or adjusted under 35 U.S.C. 154(b) by 98 days.

(21) Appl. No.: 10/237,646

(22) Filed: Sep. 9, 2002

Related U.S. Application Data

(60) Provisional application No. 60/318,387, filed on Sep. 10, 2001.

(51) Int. Cl.[7] ..... A63D 15/00
(52) U.S. Cl. ..... 473/2
(58) Field of Search ..... 473/2, 1, 5, 17, 473/44, 52, 220, 219

(56) References Cited

U.S. PATENT DOCUMENTS 4,268,033 A * 5/1981 Fontaine ..... 473/2
4,688,796 A * 8/1987 Wright ..... 473/2
5,275,398 A * 1/1994 Compton ..... 473/2
5,554,075 A * 9/1996 Glazer ..... 473/2
6,132,319 A * 10/2000 Schluter ..... 473/2
6,155,929 A * 12/2000 Chipman ..... 473/2

FOREIGN PATENT DOCUMENTS

GB 2 184 221 A * 6/1987 ..... 473/2

* cited by examiner

*Primary Examiner*—Gregory Vidovich
*Assistant Examiner*—Mitra Aryanpour
(74) *Attorney, Agent, or Firm*—Mills Law Firm PLLC

(57) ABSTRACT

A billiard training air for promoting accuracy and consistency in contacting an object ball with a cue ball to effect and desired path for the object ball and a resultant path and position for the cue ball includes an alignment body supported above the object ball, an object ball laser projecting a forward beams that is positioned on the desired path along a longitudinal axis, a impact indicating laser downwardly projecting a contact line along the object ball for indicating a contact point for the cue ball, a light unit for projecting a ghost ball image on the longitudinal axis at the contact point for indicating the impact position for the cue ball, and a pair of transverse lasers for projecting lateral beam to indicate and reference post impact cue ball position.

14 Claims, 7 Drawing Sheets

BILLIARD TRAINING AID

RELATED APPLICATION

This application claims the benefit under 35 USC 121 of U.S. Provisional Application No. 60/318,387 filed on Sep. 10, 2001 in the name of Mark Anthony Davis and entitled "Billiard Training Aid".

FIELD OF THE INVENTION

The present invention relates to billiards and pool games, and, in particular to a system for improving the shot accuracy and consistency of billiard and pool players.

BACKGROUND OF THE INVENTION

Worldwide, there are millions of active billiard and pool players, who desire to increase their proficiency in the game and spend considerable amounts of money and time in the pursuit of increased accuracy and consistency in single shot and multiple shot strategies. Fundamental to success is the ability to place an object ball at a precise location on the table or within pockets about the table periphery, as well as leaving the cue ball at a location facilitating a subsequent shot.

Many training aids have been developed for assisting in certain specific aspects of the foregoing objectives. None, however, provide a systemic approach for the interrelated reactions that determines success. Each shot requires determination of the object ball direction upon cue ball impact and resultant direction of the cue ball, and the proper speeds and spins thereof, all of which affected by the idiosyncracies or deficiencies in the player's stroke.

For example, U.S. Pat. No. 6,155,929 to Chipman discloses a cue stick having an integral laser on the longitudinal axis that is aligned with the desired impact point with the object ball. While assisting in aligning the intended initial cue ball path and maintaining stroke discipline, the player must make independent mental determinations on resultant paths of the object and cue balls and receive no resultant post shot feedback to assist in achieving consistency or assessing the efficacy of cue ball speed and spin variations. Supplemental reflective devices have been used at the table cushions in combination with cue stick lasers for predicting cue ball rebound as disclosed in U.S. Pat. No. 5,554,075 to Glazer, U.S. Pat. No. 5,275,398 to Compton, and U.S. Pat. No. 4,688,796 to Wright.

In view of the foregoing, it would be desirable to provide a training aid for use in such games that additionally provides feedback information on the post impact path and location of the cue ball to further assist in refining player techniques.

SUMMARY OF THE INVENTION

The present invention provides a training aid for billiard and pool type games incorporating a multi-task projection system for aligning the prospective shot with respect to an object ball, projecting a prescribed path for object ball travel, visually providing an impact location for the cue ball and referencing the resultant path and rest location of the cue ball to assist in improving positional play.

The billiard training aid includes a projector body supported by spaced legs vertically above the object ball and including alignment stops for positioning the object ball along the longitudinal axis of the body. A target laser unit is positioned on the longitudinal axis and projects a beam that is aligned with an intended object ball path, i.e. aligned with one of the pockets. A vertical impact laser unit carried on the body at the longitudinal axis projects a beam onto the surface of the object ball for indicating a contact point for the cue ball to effect the intended object ball path. A pair of side lasers illuminate reference lines transverse to the longitudinal axis for referencing the resultant cue ball path. Additionally, a vertical light source projects a ghost ball image representing the target impact location for the cue ball with the object ball. As a result, the player may select an object ball target objective and receive visual input on the optimum impact location in plural formats as well as feedback information on resultant cue ball location. Accordingly, the player may practice and perfect techniques for establishing accuracy and consistency in object ball travel and cue ball positioning for improving overall game strategy.

Accordingly, it is an object of the present invention to provide an apparatus for improving object and cue ball travel and positioning in billiard and pool games.

Another object of the invention is to provide a training aid providing instructive visual indications of a billiard shot and resultant cue ball position.

A further object of the invention is to provide a billiard training aid employing laser beam projection to prescribe an impact point for object ball impact and resultant repeatable information on resultant cue ball position.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
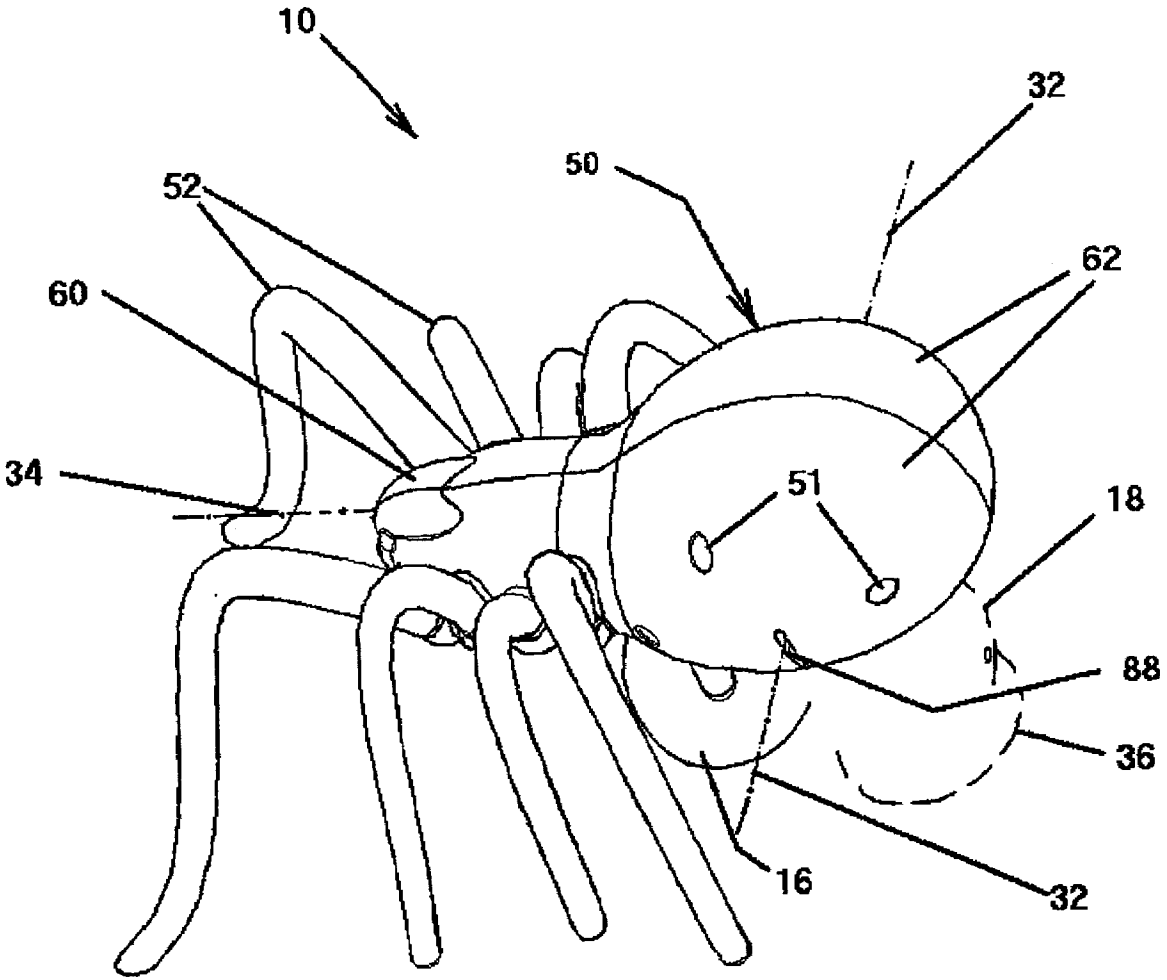
FIG. 1 is a perspective view of a billiard training aid in accordance with a preferred embodiment of the invention.
Figure 2:
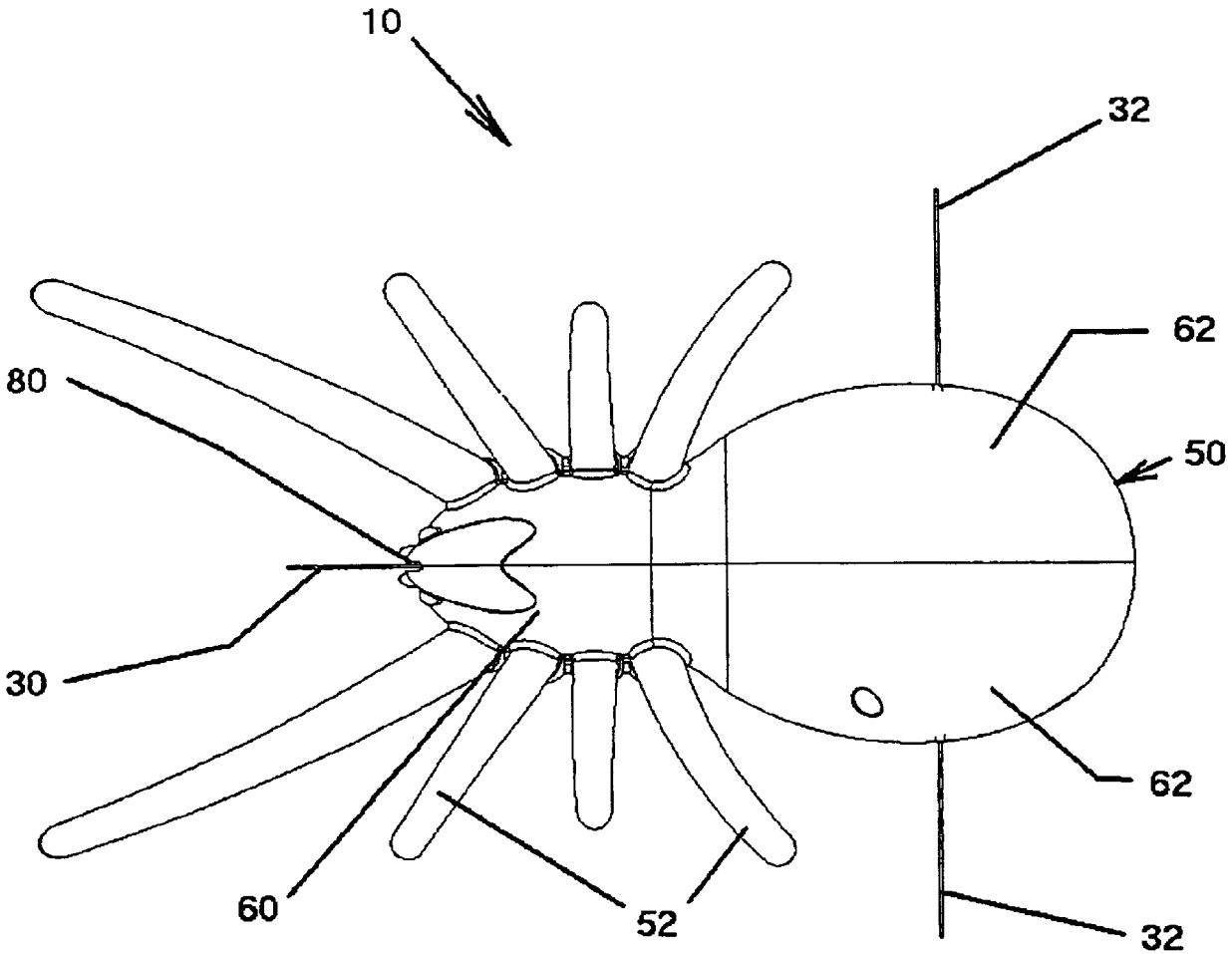
FIG. 2 is a top view of the billiard training aid.
Figure 3:
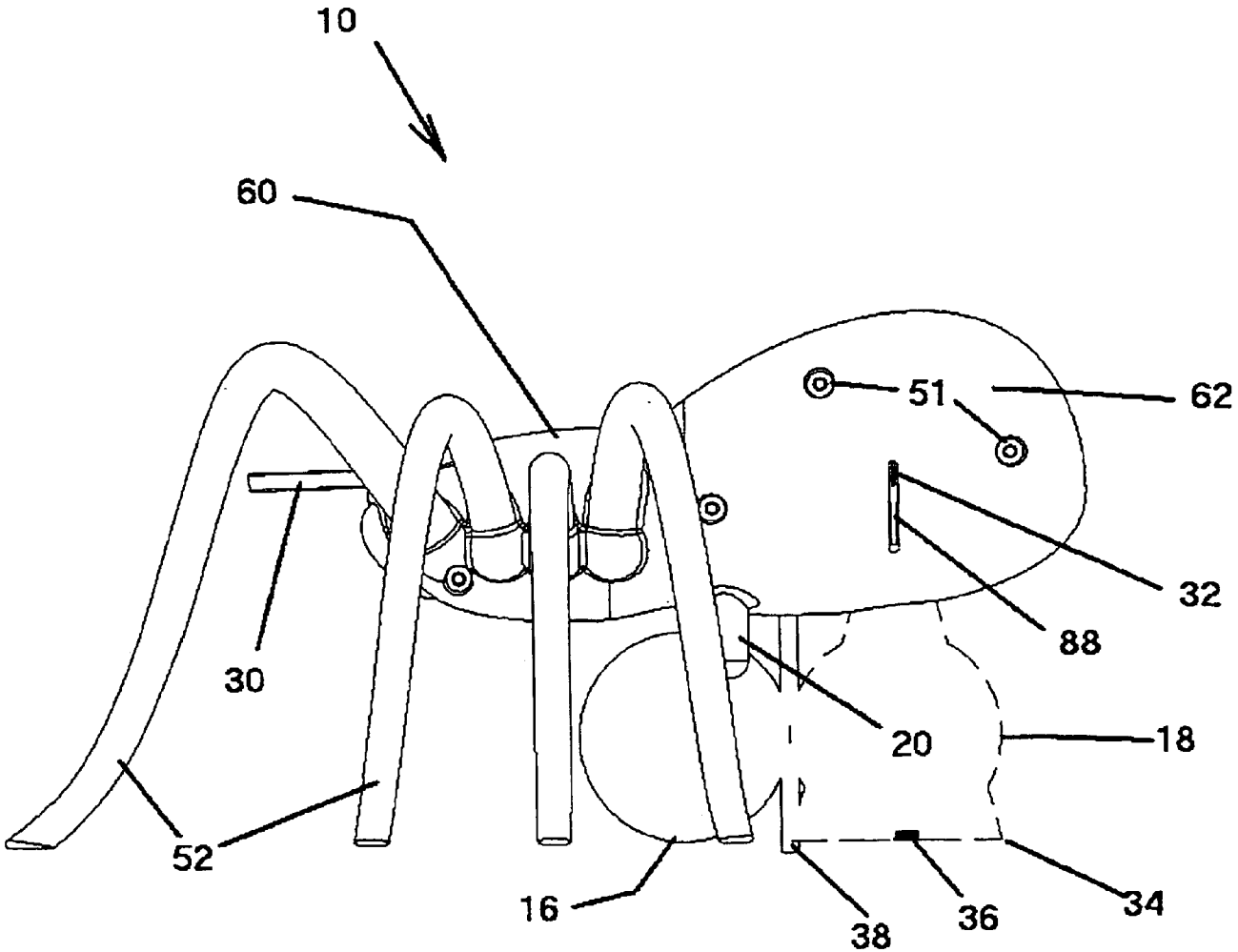
FIG. 3 is a side elevational view of the billiard training aid illustrating the object ball in solid lines and the ghost ball and ghost ring in dashed lines.
Figure 4:
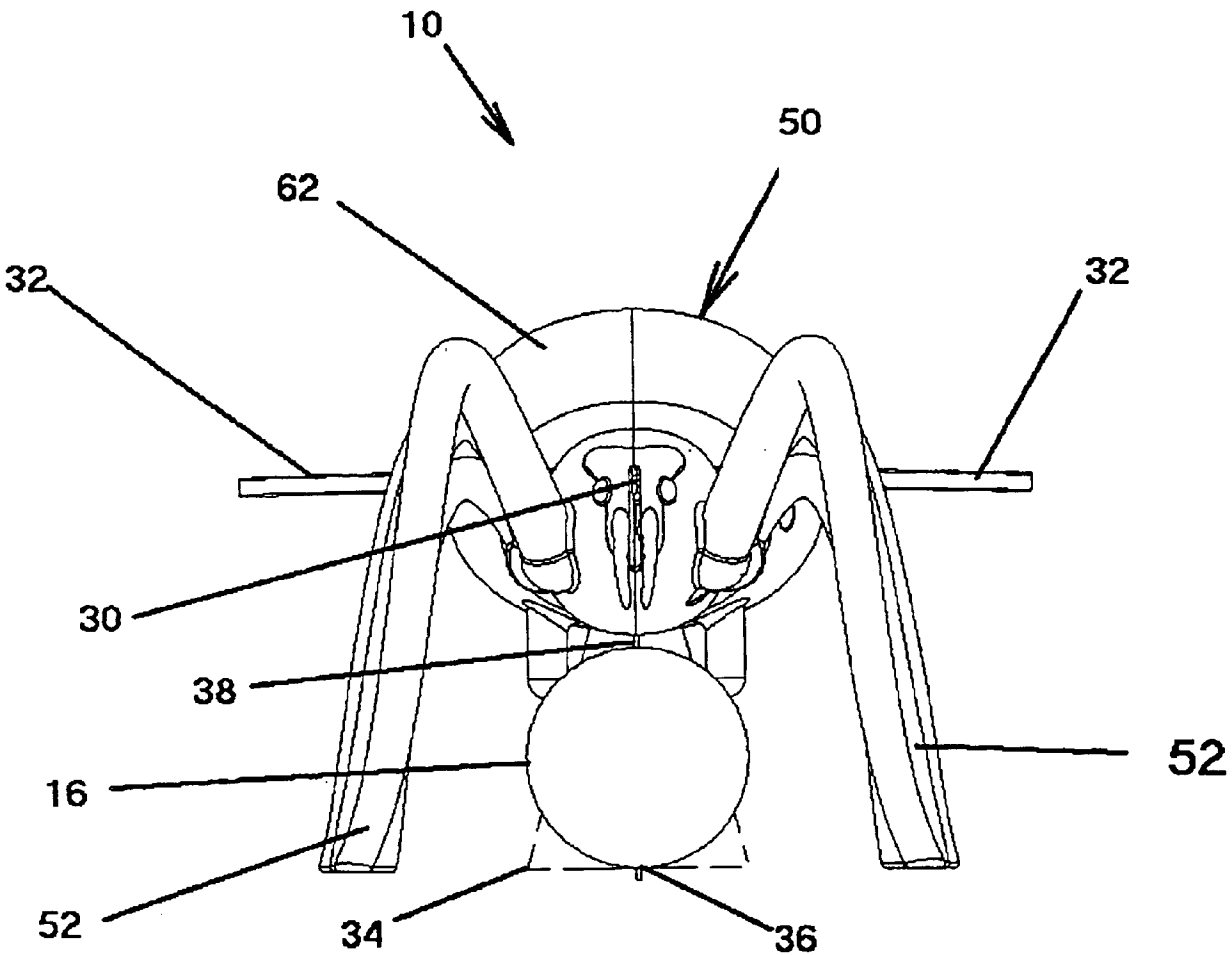
FIG. 4 is an end view of the billiard training air illustrating the object ball in solid lines and the ghost ball and ghost ring in dashed lines.

Referring to the drawings for the purpose of describing the preferred embodiment and not for limiting same, FIGS. 1 through 4 illustrate a billiard training aid 10 for use is training accuracy and consistency in billiard and pool games. As hereinafter described in detail and as further shown in FIG. 7, the training aid 10 is provided with a multi-task optical projection system for prescribing an impact position of a cue ball 16 against an object ball 18 cradled by alignment stops 20 thereby propelling the object ball 18 in a predetermined prescribed path and the cue ball 16 in a resultant refractive path.

Figure 7:
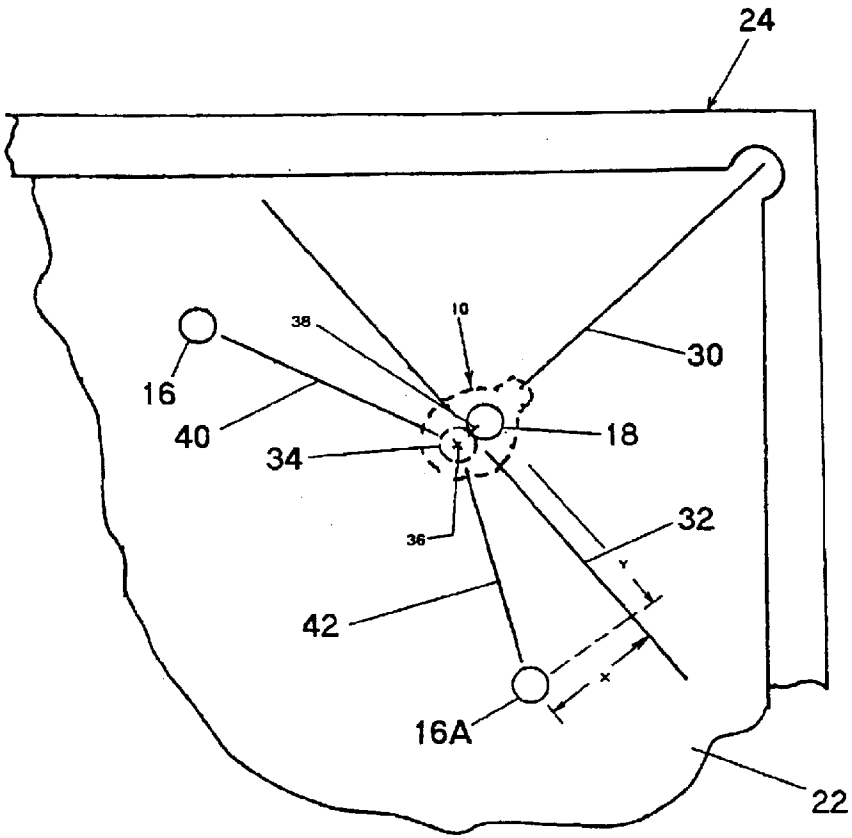
FIG. 7 is a fragmentary plan view of a billiard table illustrating the billiard training aid prescribing planned paths for a cue ball and object ball.

As shown representatively in FIG. 7, the billiard training aid 10 is positioned over the cue ball 16 on the playing surface 22 of a conventional billiard table 24 having a representative pocket 26. In aligned position, the projection system 12 projects a visible optical object ball beam 30, aligned with pocket 26, visible transverse cue ball reference beams 32, a downwardly projected ghost ball ring or annulus 34 including reference spot or indicia 36, and a vertical cue ball reference beam 38.

Stroking the cue ball 16 along an impact line 40 aligned with reference spot 36 of the ghost ball ring 34, will, in a manner well known to billiard and pool players, cause the object ball 18 to travel a course along beam 30 and, with proper momentum, fall into the pocket 26. After impact, the cue ball 16 will travel along a refractive path 42 to a rest position 16A, determining the origin of a subsequent shot that can be referenced to the beams 32, at width "X" and length "Y". Accordingly, a player may repeatedly practice a chosen shot orientation and receive feedback regarding terminal cue and object ball locations and positions. In this manner, the player may develop and improve shot techniques under varying stroke movements and strategies for cue ball and object ball placement.

The billiard training aid 10 includes a projector body 50 supported above the playing surface 22 by a plurality of support legs 52. As illustrated, the body 50 is in the form of a spider, however, it will be apparent that the structure and functional features of the training aid may be accomplished in varying fanciful and utilitarian embodiments. The body 50 is a two part molding joined in a vertical longitudinal plane by fasteners 51 and defining an interior compartment for housing the hereinafter described components. The legs 52 are transversely spaced and provide a forward tunnel for object ball travel. The rear legs are spaced in the vicinity of the object ball position so as not to obstruct cue ball travel.

The body 50 includes a head portion 60 for projecting the beam 30, side portions 62 for projecting the beams 32, and a base portion 64 for projecting the beam 38, and the ring 34 and reference spot 36. The alignment stops 20 comprise a pair of laterally spaced downwardly projecting cylindrical pins that contact the outer surface of the object ball 16 at a small diameter above its origin to prescribe an aligned location therewith.

Figure 5:
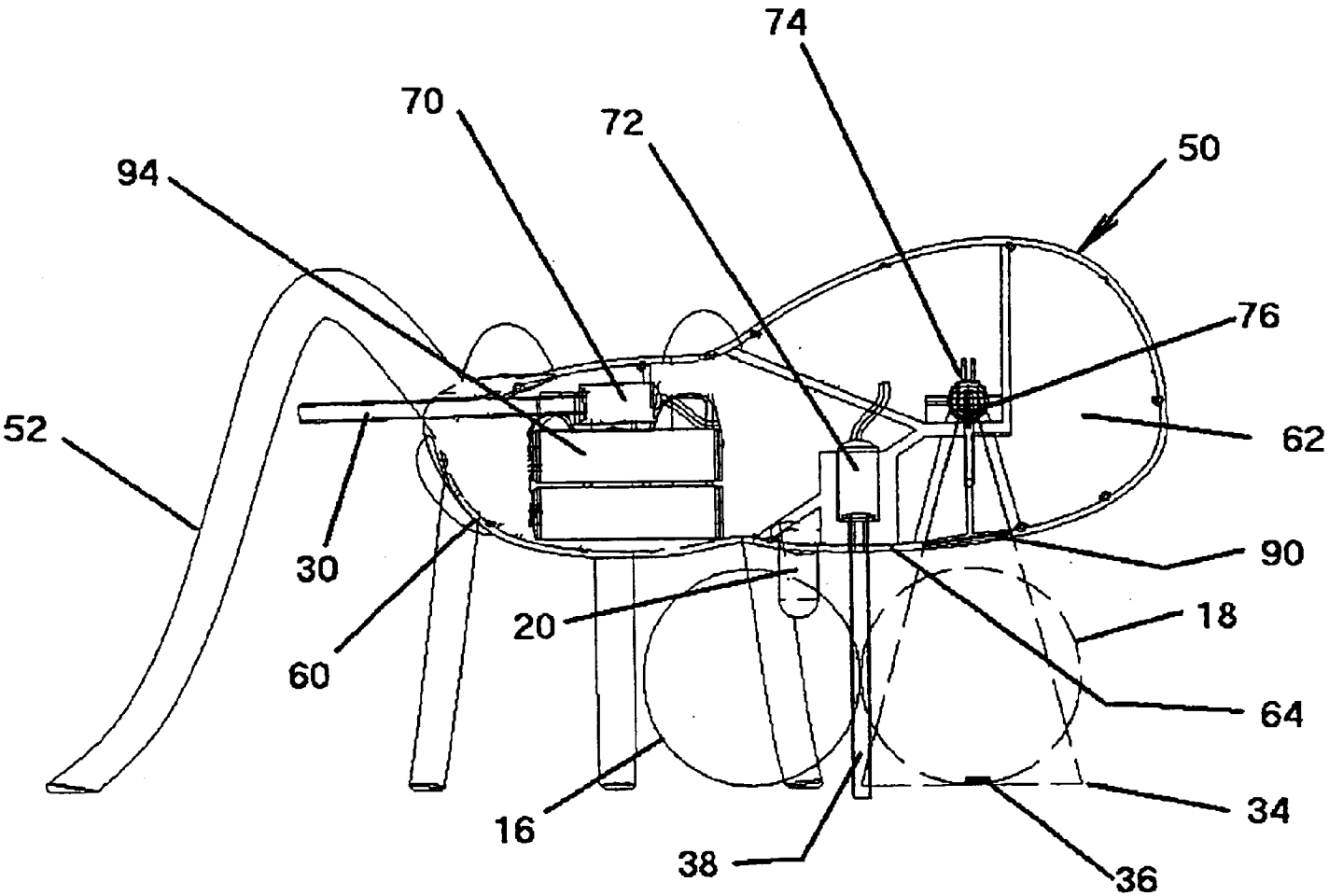
FIG. 5 is a vertical cross sectional view of the billiard training aid shown in FIG. 3.
Figure 6:
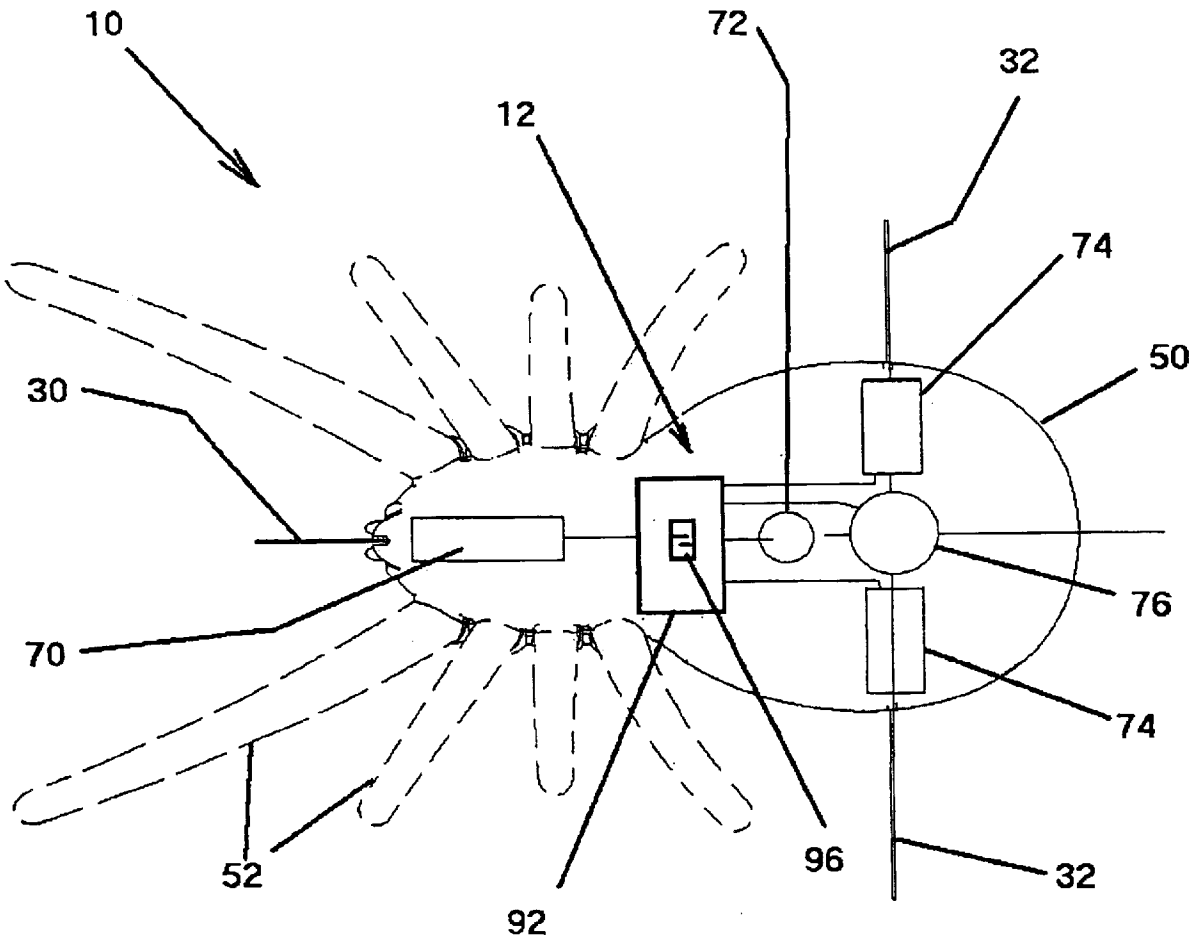
FIG. 6 is a horizontal cross sectional view of the billiard training aid as shown in FIG. 2 illustrating the multi-task projection system.

Referring to FIGS. 5 and 6, the multi-task projection system 12 includes a front laser unit 70, a base laser unit 72, side laser units 74, and a light source 76.

The front laser unit 70 projects the beam 30 through a vertical slit 80 in the head portion 60 as a vertically columninated visible line in a vertical plane along a longitudinal axis of the body 50.

The base laser unit 72 is carried on an interior wall 73 of the body interior and projects the beam 38 through an aperture in the base portion 64 aligned in the vertical plane of the beam 30 and positioned with respect to the alignment stops 20 to project a visible, columninated or non-columninated, as a visible stripe along the rear outer surface of the aligned object ball 18.

The side laser units 74 are carried on interior support walls and project the beams 32 as visible vertically columninated lines through vertical slits 88 in the side of the body. The laser units 74 and beams 32 are located in a vertical lateral plane transverse and orthogonal to the vertical longitudinal plane.

The light source 76, incandescent, laser, radiant or the like, is carried on an interior partition. The light source 76 projects illumination downwardly through an optical lens 80 carried on the base. The light source 76 and lens 79 cooperate to illuminate the ghost ring 34 and reference spot 36 at a location having an origin in the vertical plane of the beam 30 with the ghost ring tangential to the object ball at the longitudinal axis.

The laser units 70, 72 and 74, and the light source 76 are connected to a power supply 82, including a plurality of batteries 84, and operatively controlled by a switch 86 located on the exterior of the body of the training aid. The switch 86 may be employed for illuminating the sources selectively or individually. The laser units have sufficient intensity to project a consistent beam path for typical simulated shots. The units may include lenses for controlling beam width and height. A 26 mw, 650 nm commercially available laser unit has been found to provide satisfactory results. The lens 80 may be provided with refractive optics to illuminate the ghost ring in circular or outline shape.

The billiard training aid as described above may be utilized for training and entertainment in the various ball and cue stick formats, pocketed and non-pocketed formats. Thus in addition to developing shot speed and resultant cue ball travel for developing better and consistent positional play, the training aid may be used to experiment and perfect varying shot techniques. For instance, shots employing cue ball spin ("English") off center point of contact, and other stroke variation causing non-linear object ball paths may be practiced with the training aid air reoriented to account for such paths. The training aid may also be used for cushion reflective paths.

By example and with reference to FIG. 7, the player selects a practice location for the object ball 18. The training aid 10 is aligned by the stops 20 and oriented to direct the beam 30 to the desired pocket 26. The cue ball is positioned at a desired location, and the player determines a stroke position to cause the cue ball to align with the ghost ball ring 34 and/or reference spot 36. If properly stroked, the cue ball will impact the object ball propelling the latter into pocket 26 with the cue ball coming to rest at position 16A. The shot may be repeated to attain consistency; the end cue ball position varied; and differing shot techniques undertaken.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A pool training aid for use on a pool table having ball pockets comprising:

a body mounted on support means above the table and an object ball;

alignment means on said body for positioning the object ball with respect thereto along a longitudinal axis;

a first illumination device on said body projecting downwardly a visible first beam at said object ball to indicate where the object ball is to be contacted by a cue ball;

a side laser device mounted on said body orthogonal to said first beam to reference the path of the cue ball after contacting the object ball; and a front laser device positioned on said body along said longitudinal axis in a vertical plane containing said longitudinal axis to highlight the path to a pool table pocket of the object ball when it is struck by the cue ball.

2. The pool training aid as recited in claim 1 wherein said first illumination device includes a vertical laser unit for illuminating a line on the object ball along said vertical axis.

3. The pool training aid as recited in claim 1 wherein said first illumination device includes a light unit illuminating an annulus tangential to said object ball.

4. The pool training aid as recited in claim 3 wherein said light unit illuminates an indicia at the origin of said annulus.

5. The pool training aid as recited in claim 4 wherein said light unit includes a refractive lens for defining said annulus.

6. The pool training aid as recited in claim 5 wherein said support means includes a plurality of legs transversely spaced with respect to said longitudinal axis and creating a passage for travel of the object ball to the pocket.

7. The pool training aid as recited in claim 5 wherein the rearmost legs are adjacent the object ball in a location not interfering with the path of the cue ball.

8. The pool training aid as recited in claim 1 wherein said side laser device comprises a pair of laser units projecting laser beams in opposed directions transversely outwardly from said longitudinal axis.

9. The pool training aid as recited in claim 1 wherein said body and support means are formed in a shape suggestive of a spider.

10. The pool training aid as recited in claim 1 including switch means carried on said body for controlling operation of said illumination device and said laser devices.

11. A method for training a player in contacting an object ball with a cue ball on a playing surface to achieve desired resultant locations, comprising the steps of: locating the object ball and the cue ball at desired initial locations on said playing surface; determining a desired resultant location for said object ball; providing a support member in aligned position above said object ball; providing a first laser unit on said body illuminating a forward beam along an axis; adjusting said support member to direct said forward beam to the desired resultant location of said object ball; providing a second laser unit on said body illuminating a transverse beam for referencing the desired resultant location of said cue ball; providing a third illumination unit projecting on the playing surface an impact location of said cue ball to effect travel of said object ball to the desired resultant location thereof; propelling said cue ball to said resultant location for impacting the object ball and traveling the cue ball to the desired resultant position thereof; and assessing the desired resultant position of the cue ball with respect to said transverse beam.

12. The method as recited in claim 11 wherein said impact location is a circular shape illuminated by said third illumination unit.

13. The method as recited in claim 12 wherein said circular shape includes indicia indicating the origin thereof.

14. The method as recited in claim 12 wherein said impact location is indicated by a vertical laser beam transverse to said axis and illuminating an impact location on said object ball.

* * * * *